US007625476B2

(12) United States Patent
Shimoda et al.

(10) Patent No.: US 7,625,476 B2
(45) Date of Patent: Dec. 1, 2009

(54) METHOD FOR FORMING SURFACE-TREATING FILM

(75) Inventors: Masaharu Shimoda, Kanagawa-ken (JP); Eisaku Okada, Aichi-ken (JP)

(73) Assignees: Kansai Paint Co., Ltd, Kyogo-Ken (JP); Toyota Jidosha Kabushiki Kaisha, Aichi-Ken (JP)

( * ) Notice: Subject to any disclaimer, the term of this patent is extended or adjusted under 35 U.S.C. 154(b) by 176 days.

(21) Appl. No.: 11/889,007

(22) Filed: Aug. 8, 2007

(65) Prior Publication Data

US 2008/0038545 A1 Feb. 14, 2008

(30) Foreign Application Priority Data

Aug. 8, 2006 (JP) ..... 2006-215644

(51) Int. Cl.
*C25D 13/04* (2006.01)
*C25D 13/12* (2006.01)

(52) U.S. Cl. ..... 204/484

(58) Field of Classification Search ..... 204/484, 204/492

See application file for complete search history.

(56) References Cited

U.S. PATENT DOCUMENTS

2004/0244874 A1 12/2004 Nakayama et al.
2008/0254283 A1* 10/2008 Shimoda ..... 428/336

FOREIGN PATENT DOCUMENTS

| | | | |
|---|---|---|---|
| EP | 1 342 758 | A2 | 9/2003 |
| EP | 1 405 933 | A1 | 4/2004 |
| EP | 1 426 466 | A1 | 6/2004 |
| EP | 1 433 878 | A1 | 6/2004 |
| EP | 1 788 051 | A1 | 5/2007 |
| JP | 02-282499 | | 11/1990 |
| JP | 2003-155578 | | 5/2003 |
| JP | 2003-166073 | | 6/2003 |
| JP | 2003-226982 | | 8/2003 |
| JP | 2003-293161 | | 10/2003 |
| JP | 2003-328192 | | 11/2003 |
| JP | 2006-169471 | A * | 6/2006 |
| WO | 02/103080 | | 12/2002 |
| WO | 2006/109862 | | 10/2006 |

* cited by examiner

*Primary Examiner*—Kishor Mayekar
(74) *Attorney, Agent, or Firm*—Wenderoth, Lind & Ponack, L.L.P.

(57) ABSTRACT

This invention relates to a method for forming on a metal substrate a surface treating film excelling in corrosion resistance and stability of film-forming agent, by applying a film-forming agent by a multistage electrification system comprising at least two stages.

8 Claims, No Drawings

METHOD FOR FORMING SURFACE-TREATING FILM

TECHNICAL FIELD

This invention relates to a method for forming surface-treating film excelling in corrosion resistance, using a film-forming agent excelling in stability, to a film structure formed by the method and to the thereby coated articles.

BACKGROUND ART

Conventionally, metal substrates for industrial use are given in the course of surface preparation a zinc phosphate treatment for the purpose of improving corrosion resistance or adherability. However, zinc phosphate treating agent used in the chemical treatment contains large quantities of phosphorus or nitrogen and also contains large quantities of heavy metals such as nickel and manganese for improving the performance of the formed chemical coating, which gives rise to such problems as adverse influences on environments and disposal of industrial waste because the treatment generates a large amount of sludge of zinc phosphate, iron phosphate and the like.

Also for the purpose of improving corrosion resistance of industrial metal substrates, much space and time are required for coating lines for such processing steps as "degreasing—surface treatment—chemical treatment—electrodeposition coating".

JP 2003-155578A proposed a chemical treating agent for iron-and/or zinc-based substrates, which contains substantially no phosphate ion but contains zirconium ion and/or titanium ion and fluorine ion. However, the chemical treating agent for iron- and/or zinc-based substrates as described in JP 2003-155578A has a problem in that satisfactory corrosion resistance or finish cannot be secured unless a coating film is applied thereon by a coating step after the treatment using said agent.

International Publication WO 02/103080 pamphlet discloses a technology for reducing the time and space required for the treating steps by the use of a composition for metal surface treatment, which comprises (A) a compound containing at least one metal element selected from Ti, Zr, Hf and Si and (B) a fluorine-containing compound as a supply source of fluorine ion, whereby precipitating a surface treating film excelling in corrosion resistance on a metal surface containing at least either of iron or zinc, and dispensing with a surface adjustment (leveling) step. This surface treating composition disclosed in International Publication WO 02/05860 pamphlet, however, is also subject to the problem of failing to secure satisfactory corrosion resistance or finish, unless a coating film is applied thereon by a coating step after the treatment therewith.

JP 2003-166073A and JP 2003-226982A disclose a surface treating agent for lubricated steel sheet, which contains (A) amine-modified acrylic resin, (B) at least one compound selected from phosphoric acid-derived compounds, hydrofluoric acid, metal hydrofluoric acid and metal hydrofluoric acid salt, and (C) at least one compound selected from molybdenum compound, tungsten compound and vanadium compound; and which, when coated on zinc-plated steel sheet useful for automobile bodies or household electric appliances, can provide lubricated steel sheet excelling in press-shapability and corrosion resistance. However, the steel sheet which is surface treated with the surface treating agent as disclosed in JP 2003-166073A or JP 2003-226982A fails to show satisfactory corrosion resistance or finish unless a coating film is applied thereon by a coating step after the chemical treatment, and the invention cannot achieve reduction in steps or space-saving.

JP 2003-293161A discloses a polymer composition for metal surface treating agent, which comprises a specific copolymer having salicylideneamino group and amino group. The steel sheet treated with the polymer composition for metal surface treating agent as described in JP 2003-293161A again fails to show satisfactory corrosion resistance or finish, unless a coating film is applied thereon by a coating step, and the invention cannot lead to reduction in steps or space-saving.

Furthermore, JP Hei 2(1990)-282499A discloses a method for forming a coating film on apertures of coating object having complex construction such as an automobile body having apertures of not more than 500 μm in width, by cationic electrodeposition coating according to multistage electricity applying method. The method as described in JP Hei 2(1990)-282499A is effective for improving corrosion resistance of a coating object having apertures of not more than 500 μm in width, by coating the apertures, but does not amount to secure satisfactory corrosion resistance or finish.

JP 2003-328192A (EP1342758A) discloses a method for forming multilayer electrodeposition coating film by applying a cationic electrodeposition paint containing plural emulsions among which the differences in quantity of electricity necessary for starting precipitation are unified. This method, however, is yet incapable of providing sufficient corrosion resistance.

DISCLOSURE OF THE INVENTION

The object of the present invention is to offer a method for forming surface treating film excelling in corrosion resistance of the coated film and in stability of the film-forming agent.

We have engaged in concentrative studies and discovered that the above object could be achieved by applying a specific film-forming agent onto a metal substrate by multistage electricity-applying system, under specific conditions, and come to complete the present invention.

Thus, the present invention provides a method for forming a surface-treating film, which comprises applying a film-forming agent onto a metal substrate by a multistage electricity-applying system comprising at least two stages, the method being characterized in that (i) the film-forming agent comprises 30-20,000 ppm, in terms of the total amount of metal (as converted to mass), of zirconium compound and, where necessary, a compound containing at least one metal (a) which is selected from titanium, cobalt, vanadium, tungsten, molybdenum, copper, zinc, indium, aluminum, bismuth, yttrium, lanthanide metals, alkali metals and alkaline earth metals, and 1-40% by mass of an anionic group-containing resin component, (ii) the first stage coating is conducted, in the state that the metal substrate is immersed in the film-forming agent, by applying electricity at a voltage of 1-50 V for 10-360 seconds, using the metal substrate as the cathode, and (iii) the second and subsequent stage coating is conducted, in the state that the metal substrate is immersed in the film-forming agent, by applying electricity at a voltage of 50-400 V for 60-600 seconds, using the metal substrate as the anode.

This invention also provides a film structure formed by the above method, which comprises a 0.01-5 μm-thick film (X) containing, based on the total solid content by mass of the film, 25-100 mass % of the zirconium compound and the metal (a)-containing compound in terms of the total amount of the metals (as converted to mass); and 0.1-30 μm-thick film (Y) on the film (X), containing, based on the total solid content by mass of the film, less than 25 mass % of the zirconium compound and the metal (a)-containing compound in terms of the total amount of the metals (as converted to mass) and 50-95 mass % of the anionic group-containing resin component.

The surface-treating film formed by the method of the present invention excels in corrosion resistance. Also the film-forming agent used in the method of the present invention excels in stability and its corrosion resistance does not deteriorate when used in industrial lines over a prolonged period.

It is not necessarily wholly clear why the film structure formed by the method of the present invention excels in corrosion resistance. Presumably, the film (X) precipitated on the coated object contributes to suppression of corrosion under the coating film, and the 0.1-30 μm-thick film (Y) contributes to improve the finish and intercepts corrosion-promoting substances (e.g., $O_2$, $Cl^-$, $Na^+$), each performing the allotted function within the film structure.

Hereinafter the surface treating film-forming method of the present invention is explained in further details.

This invention forms on a metal substrate a surface treating film, using a specific "film-forming agent" under specific conditions, by "a multistage electricity-applying system comprising at least two stages".

Film-Forming Agent:

The film-forming agent to be used in the method of the present invention comprises 30-20,000 ppm in total of metal(s) (as converted to mass) of a metal compound component (A) composed of zirconium compound and, where necessary, a compound containing at least one metal (a) selected from titanium, cobalt, vanadium, tungsten, molybdenum, copper, zinc, indium, aluminum, bismuth, yttrium, lanthanide metals (lanthanum, cerium, praseodymium, neodymium, samarium, europium, gadolinium, terbium, dysprosium, holmium, erbium, thulium, ytterbium, ruttetium), alkali metals (lithium, sodium, potassium, rubidium, cesium, francium) and alkaline earth metals (beryllium, magnesium, calcium, strontium, barium, radium); and 1-40 mass % of anionic group-containing resin component (B).

Metal Compound Component (A):

In the first stage coating according to the present invention, film (X) comprising zirconium compound and, where necessary, further a metal (a)-containing compound is formed, as the metal ions originating from the metal compound component (A) precipitate on the metal substrate surface, by multistage electricity-applying system consisting of at least two stages. Where a zirconium compound and a metal (a)-containing compound are to be concurrently used, a single compound containing both zirconium and the metal (a) can be used instead of the concurrent use. Again, where two or more metal (a)-containing compounds are to be used concurrently, it is also possible to use a single compound containing two or more metals (a) instead of the concurrent use.

The zirconium compounds useful in the metal compound component (A) are those zirconium-containing compounds which generate zirconium-containing ions such as zirconium ion, oxyzirconium ion, fluorozirconium ion and the like. As oxyzirconium ion-generating compounds, for example, zirconyl nitrate, zirconyl acetate, zirconyl sulfate and the like; and as fluorozirconium ion-generating compounds, for example, zirconium hydrofluoric acid, zirconium hydrofluoric acid salts (e.g., sodium salt, potassium salt, lithium salt, ammonium salt and the like); can be named. Of these, ammonium fluorozirconate and zirconyl nitrate are particularly preferred.

Metal (a)-containing compounds which are useful in the metal compound component (A) where necessary are those which generate metal (a)-containing ions such as metal (a) ion, fluorometal (a) ion and the like when electricity is passed therethrough at the time of coating. More specifically, as titanium ion-generating compounds, for example, titanium chloride, titanium sulfate; as fluorotitanium ion-generating compounds, for example, titanium hydrofluoric acid, titanium hydrofluoric acid salts (e.g., sodium salt, potassium salt, lithium salt, ammonium salt and the like); can be named;

as cobalt ion-generating compounds, for example, cobalt chloride, cobalt bromide, cobalt iodide, cobalt nitrate, cobalt sulfate, cobalt acetate, ammonium cobalt sulfate and the like can be named as vanadium ion-generating compounds, for example, litium orthovanadate, sodium orthovanadate, lithium metavanadate, potassium metavanadate, sodium metavanadate, ammonium metavanadate, sodium pyrovanadate, vanadyl chloride, vanadyl sulfate and the like can be named;

as tungsten ion-generating compounds, for example, litium tungstate, sodium tungstate, potassium tungstate, ammonium tungstate, sodium metatungstate, sodium paratungstate, ammonium pentatungstate , ammonium heptatungstate, sodium phosphotungstate, barium borotungstate and the like can be named;

as molybdenum ion-generating compound, for example, lithium molybdate, sodium molybdate, potassium molybdate, ammonium heptamolybdate, calcium molybdate, magnesium molybdate, strontium molybdate, barium molybdate, phosphomolybdic acid, sodium phosphomolybdate, zinc phosphomolybdate and the like can be named;

as copper ion-generating compounds, for example copper sulfate, copper (II) nitrate trihydrate, copper (II) ammonium sulfate hexahydrate, cupric oxide, copper phosphate and the like can be named;

as zinc ion-generating compounds, for example, zinc acetate, zinc lactate, zinc oxide and the like can be named;

as indium ion-generating compounds, for example, ammonium indium sulfate can be named;

as aluminum ion-generating compounds, for example, aluminum phosphate, tricalcium aluminate, sodium aluminate and the like can be named;

as bismuth ion-generating compounds, for example, inorganic bismuth-containing compounds such as bismuth chloride, bismuth oxychloride, bismuth bromide, bismuth silicate, bismuth hydroxide, bismuth trioxide, bismuth nitrate, bismuth nitrite, bismuth oxycarbonate and the like; and organic bismuth-containing compounds such as bismuth lactate, triphenylbismuth, bismuth gallate, bismuth benzoate, bismuth citrate, bismuth methoxyacetate, bismuth acetate, bismuth formate, bismuth 2,2-dimethylolpropionate and the like can be named; and as yttrium ion-generating compounds, for example, yttrium nitrate, yttrium acetate, yttrium chloride, yttrium sulfamate, yttrium lactate, yttrium formate and the like can be named.

Among lanthanide metal compound, as those which generate lanthanum ions, for example, lanthanum nitrate, lanthanum fluoride, lanthanum acetate, lanthanum boride, lanthanum phosphate, lanthanum carbonate and the like; as cerium ion-generating compounds, for example, cerium (III) nitrate, cerium (III) chloride, cerium (III) acetate, cerium (III) oxalate, ammonium cerium (III) nitrate, diammonium cerium (IV) nitrate and the like; as praseodymium ion-generating compounds, for example, praseodymium nitrate, praseodymium sulfate, praseodymium oxalate and the like; and as neodymium ion-generating compounds, for example, neodymium nitrate, neodymium oxide and the like; can be named.

As alkali metal ion-generating compounds, for example, potassium sulfate, potassium nitrate, lithium sulfate, lithium nitrate, sodium sulfate, sodium nitrate and the like can be named.

As alkaline earth metal ion-generating compounds, for example, calcium carbonate, magnesium nitrate, magnesium oxide, magnesium titanate, magnesium orthosilicate, magnesium pyrophosphate and the like can be named.

These metal (a)-containing compounds can be used either alone or in combination of two or more.

Of these metal (a)-containing compounds, those containing metal (a) selected from titanium, cobalt, vanadium, tungsten, zinc, aluminum, lanthanum, praseodymium and magnesium are preferred. In particular, ammonium hexafluorotitanate, cobalt nitrate, ammonium metavanadate and ammonium tungstate are preferred.

Anionic Group-Containing Resin Component (B):

As the resin component to be used for the film-forming agent, anionic resins are used according to the present invention, to secure good weatherability.

Anionic resins include those containing in their molecules the groups which are anionizable in aqueous medium, such as carboxyl group, sulfonic acid group, phosphoric acid group and the like. From the viewpoint of coating stability, resins having at least one carboxyl group per molecule, in particular, at least one carboxyl group and hydroxyl group per molecule, are preferred. As such resin species, for example, polyester resin, epoxy resin, acrylic resin, polybutadiene resin, alkyd resin, polyurethane resin and the like can be named. Of these resins, particularly carboxyl-containing polyester resin (B-1), carboxyl-containing acrylic resin (B-2) and carboxyl-containing epoxy resin (B-3) are preferred, from the viewpoints of corrosion resistance and weatherability.

Carboxyl-containing polyester resin (B-1) are generally obtainable by subjecting polybasic acid and polyhydric alcohol to esterification reaction according to the accepted practice, for example, direct esterification process or ester interchange process.

As the polybasic acid, for example, dibasic acids and anhydrides thereof, e.g., phthalic anhydride, isophthalic acid, terephthalic acid, hexahydrophthalic acid, hexahydroisophthalic acid, hexahydro-terephthalic acid, tetrahydrophthalic acid, methylhexahydrophthalic acid, tetrahydrophthalic anhydride, hexahydrophthalic anhydride, succinic acid, fumaric acid, adipic acid, sebacic acid, maleic anhydride and the like; lower alkyl esters of these dibasic acids; and tri- or higher valent polybasic acids and anhydrides thereof such as trimellitic acid, hexahydrotrimellitic acid, trimellitic anhydride, methylcyclohexenetricarboxylic acid, pyromellitic anhydride and the like can be named. Of these, alicyclic polybasic acids having 1 or 2 alicyclic structures and at least two carboxyl groups per molecule, for example, hexahydrophthalic acid, hexahydroisophthalic acid, hexahydroterephthalic acid, hexahydrotrimellitic acid, tetrahydrophthalic acid, methylhexahydrophthalic acid and their anhydrides, in particular, hexahydroterephthalic acid, are preferred. Where necessary, such polybasic acid can be used concurrently with monobasic acid such as benzoic acid, crotonic acid, p-t-butylbenzoic acid or the like, for, e.g., molecular weight adjustment. Furthermore, oil fatty acid such as coconut oil fatty acid, dehydrated castor oil fatty acid and the like may also be concurrently used.

As the polyhydric alcohol, dihydric alcohol having two hydroxyl groups per molecule and polyhydric alcohol having three or more hydroxyl groups per molecule can be used. As examples of the dihydric alcohol, glycols such as ethylene glycol, diethylene glycol, triethylene glycol, tetraethylene glycol, propylene glycol, dipropylene glycol, 2-butyl-2-ethyl-1,3-propanediol, 1,4-butanediol, 1,3-butanediol, 2,3-butanediol, 1,2-butanediol, 3-methyl-1,2-butanediol, 1,2-pentanediol, 1,5-pentanediol, 1,4-pentanediol, 2,4-pentanediol, 2,2,4-trimethyl-1,3-pentanediol, 3-methyl-4,5-pentanediol, 1,6-hexanediol, 1,5-hexanediol, 1,4-hexanediol, 2,5-hexanediol, neopentyl glycol, hydroxypivalic acid neopentyl glycol ester and the like; polylactonediols formed by adding lactones such as ϵ-caprolactone to these glycols; polyesterdiols such as bis(hydroxyethyl)terephthalate; alicyclic dihydric alcohols such as 1,4-cyclohexanedimethanol, hydrogenated bisphenol A, spiroglycol and dihydroxymethyl-tricyclodecane can be named. Examples of polyhydric alcohols having at least three hydroxyl groups per molecule include glycerine, trimethylolpropane, trimethylolethane, diglycerine, triglycerine, 1,2,6-hexanetriol, pentaerythritol, dipentaerythritol, tripentaerythritol, sorbitol and mannitol.

Of these, alicyclic polyhydric alcohols having 1 or 2 alicyclic structure of around 4-6 membered ring and at least two hydroxyl groups per molecule, such as cyclohexane-1,4-dimethylol, hydrogenated bisphenol A, spiroglycol, dihydroxymethyltricyclo-decane and the like; $C_{4-9}$ glycols such as diethylene glycol, trimethylene glycol, tetraethylene glycol, triethylene glycol, dipropylene glycol, 1,4-butanediol, 1,3-butanediol, 2,3-butanediol, 1,2-butanediol, 3-methyl-1,2-butanediol, 1,2-pentanediol, 1,5-pentanediol, 1,4-pentanediol, 2,4-pentanediol, 2,3-dimethyltrimethylene glycol, tetramethylene glycol, 3-methyl-4, 5-pentanediol, 2,2,4-trimethyl-1, 3-pentanediol, 1,6-hexanediol, 1,5-hexanediol, 1,4-hexanediol, 2,5-hexanediol, neopentyl glycol an the like are preferred.

The reaction ratio of such acid group-containing compound as polybasic acid with such hydroxyl group-containing compound as polyhydric alcohol is not particularly limited, while they can be reacted at such ratios that the acid group in the acid group-containing compound normally is within a range of 0.4-0.95 mol, preferably 0.45-0.85 mol, inter alia, 0.5-0.8 mol, per mol of the hydroxyl group in the hydroxyl group-containing compound.

Introduction of carboxyl groups into so obtained polyester resin can be effected, for example, through half esterification reaction of an anhydride of above-described polybasic acid with a part of the hydroxyl groups of the polyester resin, at temperatures ranging 100-180° C. Whereby carboxyl-containing polyester resin can be obtained. In that occasion, a minor amount of a high temperature-boiling polar solvent can be added to the reaction system to reduce viscosity of the system, for higher production stability. As the high temperature-boiling polar solvent, for example, cyclohexanone can be named.

The carboxyl-containing polyester resin (B-1) can generally have a number-average molecular weight (note 1) generally ranging 500-50,000, preferably 800-10,000, inter alia, 1,000-3,000; an acid value generally ranging 5-150 mgKOH/g, preferably 8-120 mgKOH/g, inter alia, 8-100 mgKOH/g, and hydroxyl value generally within a range of 20-800 mgKOH/g, preferably 40-500 mgKOH/g, inter alia, 60-200 mgKOH/g.

(Note 1) Number-Average Molecular Weight:

This is determined from a chromatogram on RI refractometer using as the separation columns four columns of TSK GEL4000 HXL, TSK G3000 HXL, TSK G2500HXL and TSK G2000HXL (tradename Tosoh Corp.) and as the eluent tetrahydrofuran for GPC, at 40° C. and at a flow rate of 1.0 mL/min.; and calibration curve of standard polystyrene, following the method prescribed by JIS K 0124-83.

Carboxyl-containing acrylic resin (B-2) can be prepared, for example, by copolymerization of carboxyl-containing, radical-polymerizable unsaturated monomer(s) and, where necessary, hydroxyl-containing, radical-polymerizable unsaturated monomer(s) and still other radical-polymerizable unsaturated monomer(s).

As the carboxyl-containing, radical-polymerizable unsaturated monomers, for example, such monomers as acrylic acid, methacrylic acid, crotonic acid, itaconic acid, maleic acid, and fumaric acid can be used. Also as the hydroxyl-containing, radical-polymerizable unsaturated monomer, for example, 2-hydroxyethyl (meth)acrylate, 2-hydroxypropyl (meth)acrylate, 3-hydroxypropyl (meth)acrylate, hydroxybutyl (meth)acrylate and, besides the foregoing, PLACCEL FM1, PLACCEL FM2, PLACCEL FM3 (tradename, Daicel Chemical Industries, Ltd.; caprolactone-modified methacrylic acid hydroxy esters), PLACCEL FA1, PLACCEL FA2, PLACCEL FA3 (tradename, Daicel Chemical Industries, Ltd.; caprolactone-modified acrylic acid hydroxy esters) and the like can be named.

As other radical-polymerizable unsaturated monomers, for example, alkoxysylyl group-containing unsaturated monomers such as γ-(meth)acryloyloxypropyltrimethoxysilane, γ-(meth)acryloyloxypropylmethyldimethoxysilane, γ-(meth) acryloyloxypropyltriethoxysilane, vinyltrimethoxysilane and the like; $C_{1-18}$ alkyl or cycloalkyl esters of (meth)acrylic acid such as methyl (meth)acrylate, ethyl (meth)acrylate, propyl (meth)acrylate, butyl (meth)acrylate, hexyl (meth)acrylate, octyl (meth)acrylate, lauryl (meth)acrylate, cyclohexyl (meth)acrylate and the like; aromatic vinyl monomers such as styrene, α-methylstyrene, vinyltoluene and the like; (meth) acrylamide and derivatives thereof such as (meth)acrylic acid amide, N-butoxymethyl (meth)acrylamide, N-methylol (meth)acrylamide and the like; and (meth)acrylonitrile compounds can be named.

Such carboxyl-containing acrylic resins (B-2) are normally obtainable by radical polymerization of the carboxyl-containing, radical-polymerizable unsaturated monomers and, where necessary, the hydroxyl-containing, radical-polymerizable unsaturated monomers and still other radical-polymerizable unsaturated monomers, in a solvent in the presence of a polymerization initiator. In the polymerization reaction, it is preferable to use the carboxyl-containing, polymerizable unsaturated monomer within a range of 1-20 mass %, in particular, 4-10 mass %; hydroxyl-containing, radical-polymerizable unsaturated monomer, 0-40 mass %, in particular, 5-30 mass %; and other radical-polymerizable unsaturated monomer, 40-99 mass %, in particular, 60-91 mass %.

As the solvent to be used for the polymerization reaction, for example, alcohols such as propyl alcohol, isopropyl alcohol, n-butyl alcohol, t-butyl alcohol, isobutyl alcohol and the like; and ethers such as diethylene glycol monobutyl ether, methyl carbitol, 2-methoxyethanol, 2-ethoxyethanol, 2-isopropoxyethanol, 2-butoxyethanol, diethylene glycol, diethylene glycol monoethyl ether, diethylene glycol monobutyl ether, triethylene glycol monomethyl ether, 1-methoxy-2-propanol, 1-ethoxy-2-propanol, dipropylene glycol monomethyl ether and the like can be used.

Besides the foregoing, where necessary, esters like aromatic hydrocarbons such as xylene or toluene; ketones such as acetone, methyl ethyl ketone, 2-pentanone, 2-hexanone, methyl isobutyl ketone, isophorone or cyclohexanone; and esters such as methyl acetate, ethyl acetate, pentyl acetate, 3-methoxybutyl acetate, 2-ethylhexyl acetate, benzyl acetate, cyclohexyl acetate, methyl propionate or ethyl propionate can be concurrently used.

As the radical polymerization initiator to be used for the radical copolymerization, for example, peroxides such as benzoyl peroxide, di-t-butyl hydroperoxide, t-butyl hydroperoxide, cumyl peroxide, cumene hydroperoxide, diisopropylbenzane hydroperoxide, t-butyl peroxybenzoate, lauryl peroxide, acetyl peroxide, t-butyl-peroxy-2-ethyl hexanoate and the like; and azo compounds such as α,α'-azobisisobutyronitrile, azobisdimethylvaleronitrile, azobiscyclohexanecarbonitrile and the like can be named.

The carboxyl-containing acrylic resin (B-2) prepared as above can generally have a weight-average molecular weight within a range of 5,000-150,000, preferably 10,000-125,000, inter alia, 20,000-100,000[note 2]; an acid value generally within a range of 10-140 mgKOH/g, preferably 20-130 mgKOH/g, inter alia, 30-120 mgKOH/g; and a hydroxyl value generally within a range of 20-170 mgKOH/g, preferably 25-165 mgKOH/g, inter alia, 30-160 mgKOH/g.

(Note 2) Weight-Average Molecular Weight:

This can be determined from a chromatogram on RI refractometer using as the separation columns four columns of TSK GEL4000 HXL, TSK G3000 HXL, TSK G2500HXL and TSK G2000HXL (tradename, Tosoh Corp.) and as the eluent tetrahydrofuran for GPC, at 40° C. and at a flow rate of 1.0 mL/min.; and calibration curve of standard polystyrene, following the method prescribed by JIS K 0124-83.

Carboxyl-containing epoxy resin (B-3) can be obtained, for example, by adding an anhydride of a polybasic acid to a part of hydroxyl groups in an epoxy resin (B-3-1), through half esterification reaction at about 100—about 180° C.

As above epoxy resin (B-3-1), an epoxy resin having at least one epoxy group per molecule, which is obtained by reaction of a polyphenol compound with epichlorohydrin, the epoxy groups therein being blocked with an active hydrogen-containing compound (B-3-2), can be used.

As the polyphenol compound useful for forming such epoxy resin (B-3-1), those per se known can be used. As examples of such polyphenol compound, bis(4-hydroxyphenyl)-2,2-propane (bisphenol A), 4,4-dihydroxybenzophenone, bis(4-hydroxyphenyl)methane (bisphenol F), bis(4-hydroxyphenyl)-1,1-ethane, bis(4-hydroxyphenyl)-1,1-isobutane, bis(4-hydroxy-tert-butylphenyl)-2,2-propane, bis (2-hydroxynaphthyl)methane, tetra(4-hydroxyphenyl)-1,1,2,2-ethane, 4,4-dihydroxydiphenylsulfone (bisphenol S), phenol novolak, cresol novolak and the like can be named.

Also as the epoxy resin obtained by reacting such polyphenol compound with epichlorohydrin, bisphenol-type epoxy resin, in particular, those derived from bisphenol A which are expressed by the following formula, are preferred in respect of long-term corrosion resistance, e.g., exposure resistance.

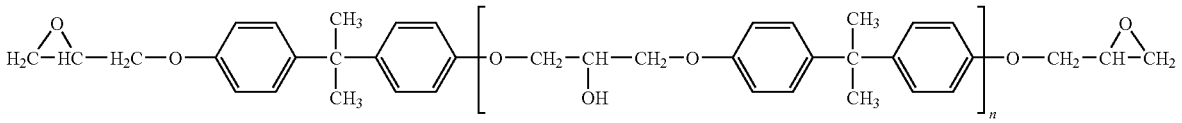

(wherein n=0-8).

As such epoxy resin (B-3-1) on the market, for example, those sold by Japan Epoxy Resin Co. under the tradenames of jER828EL, jER1002, jER1004 and jER1007 can be named.

The epoxy resin (B-3-1) can generally have a number-average molecular weight(note 1) within a range of 400-100,000, preferably 600-60,000, inter alia, 800-20,000; and an epoxy equivalent generally within a range of 180-70,000, preferably 240-40,000, inter alia, 300-15,000.

As the active hydrogen-containing compound (B-3-2) to be reacted with epoxy groups in the epoxy resin (B-3-1), phenol- or carboxyl-containing compound having at least one active hydrogen-containing group per molelcule can be used. From the standpoints of ease of the reaction and storage stability of the resin emulsion, a compound selected from the group consisting of monophenols, aliphatic monocarboxylic acids and aromatic monocarboxylic acids is preferred.

As specific examples of the monophenols, for example, phenol, cresol, ethylphenol, para-tert-butylphenol, nonylphenol and the like can be named.

As the aliphatic carboxylic acid, for example, acetic acid, propionic acid, butyric acid, valeric acid, acrylic acid, lactic acid, dimethylolpropionic acid, dimethylolbutyric acid and like can be named, and as the aromatic carboxylic acid, for example, benzoic acid, gallic acid and the like can be named.

The reaction ratio of active hydrogen groups of the active hydrogen-containing compound-(B-3-2) to epoxy groups of the epoxy resin (B-3-1) is normally 1.5-0.75 mol, preferably 1.2-0.8 mol per mol of the epoxy group. Because the epoxy groups in the epoxy resin (B-3-1) are blocked with the active hydrogen-containing compound (B-3-2), they excel in preservation stability.

Carboxyl-containing epoxy resin (B-3) can be prepared by the steps of blocking epoxy groups in the epoxy resin (B-3-1) with active hydrogen-containing compound (B-3-2) and further reacting the same resin with an acid anhydride compound (B-3-3) to introduce carboxyl groups.

As the acid anhydride compound (B-3-3), for example, anhydrides of dibasic acids such as succinic acid, maleic acid, phthalic acid, hexahydrophthalic acid, tetrahydrophthalic acid, methylhexahydrophthalic acid and the like can be named. Also tribasic acid monoanhydride such as trimellitic anhydride can be used.

Thus obtained carboxyl-containing epoxy resin (B-3) can generally have an acid value of 0.1-150 mgKOH/g, preferably 0.5-120 mgKOH/g, inter alia, 1-100 mgKOH/g.

The anionic group-containing resin component (B) can further contain, where necessary, blocked polyisocyanate compound and/or melamine resin as crosslinking agent. As the blocked polyisocyanate compound, aromatic, alicyclic or aliphatic polyisocyanate compounds which are blocked with a blocking agent can be named. They can be used either alone or in combination of two or more.

Specific examples of aromatic polyisocyanate include 1,3- or 1,4-phenylenediisocyanate, 2,4-or 2,6-tolylene diisocyanate (TDI), crude TDI, 2,4'- or 4,4'-diphenylmethane diisocyanate (MDI), 4,4'-diisocyanatobiphenyl, 3, 3'-dimethyl-4,4'-diisocyanatobiphenyl, 3,3'-dimethyl-4,4-diisocyanatodiphenylmethane, crude MDI, 1,5-naphthylene diisocyanate, 4,4'-4"-triphenylmethane triisocyanate, m- or p-isocyanatophenylsulfonyl isocyanate and the like.

Specific examples of aliphatic polyisocyanate include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, 2-(isocyanatomethyl-2,6-diisocyanatohexanoate) and the like.

Specific examples of alicyclic polyisocyanate include isophorone diisocyanate (IPDI), dicyclohexylmethane-4,4'-diisocyanate (hydrogenated MDI), p-xylylenediisocyanate (XDII), α,α,α',α',-tetramethylxylylene diisocyanate (TMXDI), cyclohexylene diisocyanate and the like.

Of these polyisocyanate compounds, aliphatic polyisocyanate or alicyclic polyisocyanate are preferred from the standpoint of weatherability.

The blocking agent adds to isocyanate groups in the polyisocyanate compounds to block the compounds. It is desirable that the blocked polyisocyanate compounds formed upon addition of such blocking agent are stable at ambient temperature but dissociate the blocking agent when heated to about 100° C.-about 200° C., general baking temperature range of electrodeposition coating, to regenerate the isocyanate groups.

As blocking agents satisfying such requirement, for example, lactam compounds such as ε-caprolactam and γ-butyrolactam; oxime compounds such as methyl ethyl ketoxime and cyclohexanoxime; phenolic compounds such as phenol, para-t-butylphenol and cresol; aliphatic alcohols such as n-butanol and 2-ethylhexanol; aromatic alkylalcohols such as phenylcarbinol and methylphenylcarbinol; ether alcoholic compounds such as ethylene glycol monobutyl ether and diethylene glycol monoethyl ether; and hydroxyl-containing compounds such as propylene glycol, dipropylene glycol, 1,3-butanediol, 1,2-butanediol, 3-methyl-1,2-butanediol, 1,2-pentanediol, 1,4-pentanediol, 3-methyl-4,3-pentanediol, 3-methyl-4,5-pentanediol, 2,2,4-trimethyl-1,3-pentanediol, 1,5-hexanediol, 1,4-hexanediol, 2,2-diimethylolpropionic acid, 2,2-dimethylolbutanoic acid, dimethylolvaleric acid and glyceric acid.

Among those blocked polyisocyanate compounds, isophorone diisocyanate blocked with methyl ethyl ketoxime is particularly preferred.

As the melamine resin, for example, methylolated melamine resin formed by methylolating melamine with formaldehyde; alkylated melamine resin formed by etherifying the methylol groups with monohydric alcohol; methylolated melamine resin having imino groups; alkylated melamine resin and the like can be named. Mixed alkylated melamine resin obtained by using two or more monohydric alcohols in the occasion of etherifying the methylol groups can also be used. As useful monohydric alcohol, for example, methyl alcohol, ethyl alcohol, n-propyl alcohol, i-propyl alcohol, n-butyl alcohol, i-butyl alcohol, t-butyl alcohol, 2-ethylbutanol, 2-ethylhexanol and the like can be named.

As specific melamine resins, for example, methylated melamine resin, imino-containing methylated melamine resin, methylated-butylated melamine resin, imino-containing methylated-butylated melamine resin and the like can be named, methylated melamine resin and methylated-butylated melamine resin being particularly preferred.

As commercially available products of these melamine resins, for example, Cymel 202, Cymel 232, Cymel 235, Cymel 236, Cymel 238, Cymel 254, Cymel 266, Cymel 267, Cymel 272, Cymel 285, Cymel 301, Cymel 303, Cymel 325, Cymel 327, Cymel 350, Cymel 370, Cymel 701, Cymel 703, Cymel 736, Cymel 738, Cymel 771, Cymel 1141, Cymel 1156, Cymel 1158, and the like (tradename, Nihon Cytec Industries, Inc., Ltd.); U-Van 120, U-Van 20HS, U-Van 2021, U-Van 2028, U-Van 2061 and the like (tradename, Mitsui Chemicals, Inc.); Melan 522 (tradename: Hitachi Chemical) and the like can be named.

The blend ratio of the anionic resin (base resin) and crosslinking agent in the anionic group-containing resin component (B) is: the anionic resin is normally within a range of 50-90 mass %, preferably 55-85 mass %, inter alia, 60-80 mass %; and the crosslinking agent is normally within a range of 10-50 mass %, preferably 15-45 mass %, inter alia, 20-40 mass %; based on the mass of the total solid content of the anionic resin and crosslinking agent.

Above-described anionic group-containing resin component (B) can be made into a resin emulsion by converting it to an aqueous dispersion, adding thereto a neutralizer such as a basic compound and deionized water. The emulsion can be used for preparation of the film-forming agent of the present invention.

As the basic compound, for example, hydroxides of alkali metals or alkaline earth metals such as sodium hydroxide, potassium hydroxide, lithium hydroxide, calcium hydroxide, barium hydroxide and the like; ammonia; primary monoamines such as ethylamine, propylamine, butylamine, benzylamine, monoethanolamine, neopentanolamine, 2-aminopropanol, 3-aminopropanol and the like; secondary monoamines such as diethylamine, diethanolamine, di-n- or di-iso-propanolamine, N-methylethanolamine, N-ethylethanolamine and the like; tertiary monoamines such as dimethylethanolamine, trimethylamine, triethylamine, triisopropylamine, methyldiethanolamine, dimethylaminoethanol and the like; and polyamines such as diethylenetriamine, hydroxyethylaminoethylamine, ethylaminoethylamine, methylaminopropylamine and the like can be named.

Such basic compound is used normally within a range of 0.1-1 equivalent, preferably 0.3-0.9 equivalent, per the carboxyl groups in the anionic group-containing resin component (B).

The film-forming agent contains the metal compound component (A) comprising zirconium compound and, where necessary, compound(s) containing at least one metal (a) selected from titanium, cobalt, vanadium, tungsten, molybdenum, copper, zinc, indium, aluminum, bismuth, yttrium, lanthanide metals, alkali metals and alkaline earth metals, in the total metal amount (as converted to mass) of 30-20,000 ppm, preferably 50-10,000 ppm, inter alia, 100-5,000 ppm; and the anionic group-containing resin component (B), in an amount of 1-40 mass %, preferably 5-35 mass %, inter alia, 10-30 mass %; and is capable of forming a film structure excelling in corrosion resistance.

Where the metal compound component (A) contains metal (a)-containing compound(s), its content is variable according to the intended utility of coated article formed by the method of the present invention, while generally it can be no more than 90 mass %, preferably within a range of 5-80 mass %, inter alia, 10-75 mass %, based on the mass of the metal compound component (A).

The film-forming agent can further contain other additives, where necessary, for example, pigment, catalyst, organic solvent, pigment dispersant, surface treating agent, surfactant and the like, each in an amount customary in the art of paint. As the pigment or catalyst, for example, coloring pigment such as titanium white and carbon black; extender such as clay, talc and baryta; rust-preventive pigment such as aluminum dihydrogentripolyphosphate and aluminum phosphomolybdate; organotin compound such as dibutyltin oxide and dioctyltin oxide; and tin compound such as aliphatic or aromatic carboxylate of dialkyltin, e.g., dibutyltin dilaurate, dioctyltin dilaurate, dibutyltin diacetate, dioctyltin dibenzoate and dibutyltin dibenzoate can be named.

The film-forming agent can be formulated, for example, by the following methods (1)-(3):

(1) a method comprising combining the anionic group-containing resin component (B) and optionally other additives; thoroughly mixing them to form a dissolved varnish; adding thereto, in an aqueous medium, a neutralizer selected from, for example, hydroxides of alkali metals or alkaline earth metals such as sodium hydroxide, potassium hydroxide, lithium hydroxide, calcium hydroxide, barium hydroxide and the like; ammonia; primary monoamines such as ethylamine, propylamine, butylamine, benzylamine, monoethanolamine, neopentanolamine, 2-aminopropanol, 3-aminopropanol and the like; secondary monoamines such as diethylamine, diethanolamine, di-n- or di-iso-propanolamine, N-methylethanolamine, N-ethylethanolamine and the like; tertiary monoamines such as dimethylethanolamine, trimethylamine, triethylamine, triisopropylamine, methyldiethanolamine, dimethylaminoethanol and the like; and polyamines such as diethylenetriamine, hydroxyethylaminoethylamine, ethylaminoethylamine, methylaminopropylamine and the like; and mixtures of two or more of these, to disperse the varnish in the water and blending in the so formed emulsion the metal compound component (A);

(2) a method comprising adding to the metal compound component (A) pigment, catalyst, other additives and water to disperse them in the water and prepare a pigment-dispersed paste in advance; and adding the paste to an emulsion of the anionic group-containing resin component (B); and (3) a method comprising diluting the metal compound component (A) with water and blending the same with an advancedly prepared electrodeposition paint bath.

The film-forming agent can be diluted with deionized water or the like, to adjust the solid concentration in its bath to normally within a range of 5-40 mass %, preferably 8-20 mass %, and its pH, normally within a range of 4-9, preferably 5-8, and used.

The film-forming agent prepared as so for described is capable of forming the film structure intended by the present invention on metal substrate, by the hereinafter described at least two-stage multistage electricity application system.

Coating by Multistage Electricity Application System

Coating of the film-forming agent according to the present invention can be effected by multistage electricity application system. Specifically, above-described film-forming agent is used as the bath and the first stage coating is conducted by passing electricity generally at a voltage ($V_1$) of 1-100 V, preferably 1-50 V, inter alia, 5-40 V, normally for 10-360 seconds, preferably 30-180 seconds, in the state that the metal substrate serving as the cathode is immersed in the film-forming agent; and then the second and subsequent stage coating, by passing electricity generally at a voltage ($V_2$) of 50-400 V, preferably 75-370 V, inter alia, 100-350 V, normally for 60-600 seconds, preferably 75-400 seconds, inter alia, 90-240 seconds, in the state that the metal substrate serving as the anode is immersed in the film-forming agent.

Thus, by the first stage coating wherein the metal substrate is used as the cathode, the metal compound component (A) is selectively precipitated on the metal substrate to form film (X), and then by the second and subsequent stage coating using the metal substrate as the anode, the anionic group-containing resin component (B) is selectively precipitated on the film (X) having electric resistance, to form film (Y).

By the reversal of the state wherein the metal substrate which is immersed in the film-forming agent is used as the cathode, to the state wherein the coated object is used as the anode according to the present invention, the second film (Y) having a largely different composition can be continuously formed on the first film (X), whereby forming multilayer film structure exhibiting still better corrosion resistance.

In particular, for satisfactory formation of the film (Y) on the film (X), it is desirable to perform the first stage coating at a current density of generally 0.1-1.5 mA/cm$^2$, preferably 0.15-1.2 mA/cm$^2$, inter alia, 0.2-1.0 mA/cm$^2$.

The precipitation mechanism of above multilayer film is: first, under the first stage electrification conditions using the metal substrate as the cathode, zirconium ion species (e.g., complex ion of zirconium and fluorine) in the film-forming agent are hydrolyzed due to the pH rise in the vicinity of the metal substrate, and precipitate on the metal substrate as a difficulty soluble film (X) (mainly zirconium oxide). Then, by the second stage electrification, the metal substrate is switched to anode and during the second stage electrification the pH in the vicinity of the metal substrate drops whereby to prevent precipitation of difficulty soluble zirconium oxide on the metal substrate, and the film (Y) whose chief component is the anionic group-containing resin component (B) or pigment is formed. The film structure of the present invention is thus obtained.

Depending on the electrification conditions, a film composed chiefly of the anionic group-containing resin component (B) or pigment may precipitate during the first stage electrification, on the anode which is the opposite pole in the first stage electrification. It is therefore desirable to facilitate continuous coating in the second and subsequent stage(s) electrification using the metal substrate as the anode, to use as the electrode one covered with diaphragm (diaphragm electrode) to prevent adhesion of the anionic group-containing resin component (B) onto the electrode surface.

As the bath temperature of the film-forming agnet, normally adequate range is 5-45° C., preferably 10-40° C., inter alia, 20-35° C.

The precipitated film can be cured by baking. Normally adequate baking temperature of the film ranges about 100-about 200° C., preferably about 120-about 180° C., at the surface of the object to be coated; and the baking time can range 5-90 minutes, preferably 10-50 minutes.

Upon coating of the film-forming agent by the above multistage electrification system according to the present invention, a film structure can be formed on the metal substrate, the structure comprising a 0.01-5 μm-thick, in particular, 0.03-5 μm-thick film (X) containing, based on the total solid mass content of the film, 25-100 mass %, in particular, 30-99 mass %, inter alia, 35-95 mass %, of the zirconium compound and the metal (a)-containing compound in terms of the total amount of the metals (as converted to mass); and 0.1-30 μm-thick, in particular, 0.5-25 μm-thick film (Y) on the above film (X), containing, based on the total solid mass content of the film, less than 25 mass %, in particular, 0.5-20 mass %, inter alia, 1-10 mass %, of the zirconium compound and the metal (a)-containing compound in terms of the total amount of the metals (as converted to mass) and 50-95 mass %, in particular, 60-92.5 mass %, inter alia, 70-90 mass %, of the anionic group-containing resin component.

EXAMPLES

Hereinafter the present invention is explained still more specifically, referring to working Examples, in which "part" and "%" are "mass part" and "mass %".

Production Example 1

Preparation of Carboxyl-Containing Polyester Resin

A reaction apparatus equipped with a heater, stirrer, nitrogen inlet tube and a separator was charged with 550 parts of hexahydrophthalic anhydride, 160 parts of adipic acid, 220 parts of trimethylolpropane, 170 parts of neopentyl glycol and 350 parts of 2-butyl-2-ethyl-1,3-propanediol. Heating was started under dry nitrogen and the temperature was gradually raised to 230° C. to carry out an esterification reaction.

While maintaining the temperature of 230° C., the esterification was continued until the acid value dropped to not higher than 1 mgKOH/g. The esterification product was cooled to 170° C., to which 160 parts of trimellitic anhydride, and then 380 parts of ethylene glycol monobutyl ether, were added to provide a carboxyl-containing polyester resin solution having a solid content of 80%. The carboxyl-containing polyester resin had an acid value of 60 mgKOH/g, hydroxyl value of 90 mgKOH/g and number-average molecular weight of 1,500.

Production Example 2

Preparation of Carboxyl-Containing Acrylic Resin

A flask equipped with a stirrer, thermometer, nitrogen inlet tube and a reflux condenser was charged with 290 parts of propylene glycol monomethyl ether and kept at 120° C. Into the flask a mixture of the following components was dropped over 3 hours, and then 3 parts of azobisdimethylvaleronitrile was added, to be reacted at a constant temperature of 120° C. for another hour. Thus a carboxyl-containing acrylic resin solution having a solid resin content of 65% was obtained. The carboxyl-containing acrylic resin had an acid value of 78 mgKOH/g, hydroxyl value of 145 mgKOH/g and weight-average molecular weight of 16,000.

| Mixture | Parts |
|---|---|
| styrene | 60 |
| n-butyl acrylate | 300 |
| 2-hydroxyethyl acrylate | 180 |
| acrylic acid | 60 |
| azobisdiisobutyronitile | 36 |

Production Example 3

Preparation of Carboxyl-Containing Epoxy Resin

A flask equipped with a stirrer, thermometer, nitrogen inlet tube and a reflux condenser was charged with 500 parts of jER828EL (tradename, Japan Epoxy Resin Co., an epoxy resin having an epoxy equivalent of 190 and molecular weight of 350) and to which 200 parts of bisphenol A and 0.1 part of dimethylbenzylamine were added, followed by their reaction at 130° C. until the epoxy equivalent increased to 750. Then 135 parts of dimethylolbutyric acid was added, and the reaction was continued at 130° C. for further 4 hours. Successively adding 77 parts of trimellitic anhydride and then 228 parts of ethylene glycol monobutyl ether, a carboxyl-containing epoxy resin solution having a solid content of 80% was obtained. This carboxyl-containing epoxy resin had an acid value of 78 mgKOH/g, hydroxyl value of 140 mgKOH/g and number-average molecular weight of about 1800.

Production Examples 6-8

Preparation of Emulsions No. 2-No. 4

Emulsion Nos. 2-4 each having the blended composition as shown in Table 1 were prepared by the operations similar to Production Example 5.

TABLE 1

| | | Production Example 5 | Production Example 6 | Production Example 7 | Production Example 8 |
|---|---|---|---|---|---|
| | Emulsion | No. 1 | No. 2 | No. 3 | No. 4 |
| Base resin | carboxyl-containing polyester resin solution solid content 80% | 87.5 (70) | | | 87.5 (70) |
| | carboxyl-containing acrylic resin solution solid content 65% | | 107.7 (70) | | |
| | carboxyl-containing epoxy resin solution solid content 80% | | | 87.5 (70) | |
| Hardener | hardener No. 1 solid content 90% | 33.3 (30) | 33.3 (30) | 33.3 (30) | 16.7 (15) |
| | NIKALAC MX-430 (note 3) | | | | 15 (15) |
| Neutralizer | triethylamine | 3 | 3 | 3 | 3 |
| | Deionized water | 188.7 | 168.5 | 188.7 | 190.3 |
| | 32% emulsion | 312.5 (100) | 312.5 (100) | 312.5 (100) | 312.5 (100) |

The numerals show blended amount and the parenthesized numerals show solid content.
(note 3) NIKALAC MX-430: tradename, Sanwa Chemical Co., a melamine resin, solid content: 100%.

Production Example 4

Preparation of Hardener No. 1

To 222 parts of isophorone diisocyanate, 44 parts of methyl isobutyl ketone was added, and the temperature was raised to 70° C. Thereafter 174 parts of methyl ethyl ketoxime was dropped into the reaction system over 2 hours. While maintaining this temperature, the system was sampled with time until absence of unreacted isocyanate was confirmed by infrared absorption spectroanalysis. Thus hardener No. 1 of blocked polyisocyanate compound having a solid content of 90% was obtained.

Production Example 5

Preparation of Emulsion No. 1

To 87.5 parts (solid content, 70 parts) of the carboxyl-containing polyester resin having a solid content of 80% as obtained in the above Production Example 1, 33.3 parts (solid content, 30 parts) of the hardener No. 1, 3 parts (for neutralization of 0.4 equivalent) of triethylamine and 188.7 parts of deionized water were added to form an aqueous dispersion, from which emulsion No. 1 having a solid content of 32% was obtained.

Production Example 9

Preparation of Acrylic Resin Solution for Dispersing Pigment

A conventional acrylic resin reaction tank equipped with a stirrer, thermometer and reflux condenser was charged with 37 parts of ethylene glycol monobutyl ether, which was heated under stirring and maintained at 110° C.

Into the reaction tank a mixture of the following components was dropped over a period of 3 hours, followed by 30 minutes aging at 110° C. Then an additional mixed catalyst solution formed of 20 parts of ethylene glycol monobutyl ether and 0.5 part of azobisisobutyronitrile was dropped over an hour, followed by an hour's aging at 110° C. Cooling the reaction product, an acrylic resin solution for dispersing pigment, having a solid content of 55% was obtained.

| Mixture | Part(s) |
|---|---|
| styrene | 10 |
| methyl methacrylate | 35 |
| 2-ethylhexyl methacrylate | 20 |
| 2-hydroxyethyl methacrylate | 10 |
| NF BISOMER S20W(note 4) | 40 |
| azobisisobutyronitrile | 1 |
| isobutyl alcohol | 5 |

(note 4)NF BISOMER S20W: tradename, Dai-ichi Kogyo Seiyaku Co., Ltd. a 50% aqueous dilution of methoxypolyethylene glycol monomethacrylate, molelcular weight: about 2,080.

Production Example 10

Preparation of Pigment-Dispersed Paste No. 1

The acrylic resin solution for dispersing pigment, having a solid content of 55% as obtained in Production Example 9, 6.3 parts (solid content: 5 parts); JR-600E(note 5), 14 parts; CARBON MA-7(note 6), 0.3 part; HYDRITE PXN(note 7), 9.7 parts; dioctyltin oxide, 1 part; and deionized water, 23.2 parts were dispersed in a ball mill for 20 hours, to provide a pigment-dispersed paste No. 1 having a solid content of 55%.

Production Example 11

Preparation of Pigment-Dispersed Paste No. 2

Pigment-dispersed paste No. 2 was prepared by the operations similar to Production Example 10, except that the components as identified in the following Table 2 were used.

TABLE 2

| | | Production Example 10 | Production Example 11 |
|---|---|---|---|
| Pigment-dispersed paste | | No. 1 | No. 2 |
| Dispersing resin | acrylic resin solution for dispersing pigment solid content 55% | 6.3 (5.0) | 6.3 (5.0) |
| | ammonium fluorozirconate | | 1.3 (1.3) |
| | ammonium fluorotitanate | | 2.1 (2.1) |

TABLE 2-continued

| | | Production Example 10 | Production Example 11 |
|---|---|---|---|
| Coloring pigment | JR-600E (Note 5) | 14.0 (14) | 14.0 (14) |
| | CARBON MA-7 (Note 6) | 0.3 (0.3) | 0.3 (0.3) |
| Extender | HYDRITE PXN (Note 7) | 9.7 (9.7) | 9.7 (9.7) |
| Tin catalyst | Dioctyltin oxide | 1.0 (1.0) | 1.0 (1.0) |
| Deionized water | | 23.2 | 25.8 |
| 55% Pigment-dispersed paste | | 54.5 (30) | 60.5 (33.3) |

Parenthesized numerals show solid content.
(Note 5)
JR-600E: tradename, Tayca Corporation, titanium white
(Note 6)
CARBON MA-7: tradename, Mitsubishi Chemical Co., carbon black
(Note 7)
HYDRIDE PXN: tradename, Georgia Kaolin Co., kaolin Production Example 12

Emulsion No. 1, 219 parts (solid content: 70 parts), 55% pigment-dispersed paste No. 1 as obtained in Production Example 10, 54.5 parts (solid content: 30 parts) and deionized water, 726.5 parts were mixed to form a bath having a solid content of 10%, and to which 1.3 parts of ammonium fluorozirconate was added to provide film-forming agent No. 1.

Production Examples 13-26

Film-forming agent Nos. 2-15 were prepared in the manner similar to Example 13, except that the blends as shown in the following Tables 3 and 4 were used.

TABLE 3

| | | Production Example 12 | Production Example 13 | Production Example 14 | Production Example 15 | Production Example 16 | Production Example 17 | Production Example 18 | Production Example 19 | Production Example 20 |
|---|---|---|---|---|---|---|---|---|---|---|
| | Film-forming agent | No. 1 | No. 2 | No. 3 | No. 4 | No. 5 | No. 6 | No. 7 | No. 8 | No. 9 |
| Bath | Emulsion No. 1 | 219.0 (70) | | | | 219.0 (70) | 219.0 (70) | 219.0 (70) | 219.0 (70) | 219.0 (70) |
| | Emulsion No. 2 | | 219.0 (70) | | | | | | | |
| | Emulsion No. 3 | | | 219.0 (70) | | | | | | |
| | Emulsion No. 4 | | | | 219.0 (70) | 219.0 (70) | 219.0 (70) | 219.0 (70) | 219.0 (70) | 219.0 (70) |
| | Pigment-dispersed paste No. 1 | 54.5 (30) | 54.5 (30) | 54.5 (30) | 54.5 (30) | 54.5 (30) | 54.5 (30) | 54.5 (30) | 54.5 (30) | 54.5 (30) |
| | Deionized water | 726.5 | 726.5 | 726.5 | 726.5 | 726.5 | 726.5 | 726.5 | 726.5 | 726.5 |
| | 10% Bath | 1000 (100) | 1000 (100) | 1000 (100) | 1000 (100) | 1000 (100) | 1000 (100) | 1000 (100) | 1000 (100) | 1000 (100) |
| Zr | ammonium fluorozirconate | 1.3 (1.3) | 1.3 (1.3) | 1.3 (1.3) | 1.3 (1.3) | 1.3 (1.3) | 1.3 (1.3) | 1.3 (1.3) | 1.3 (1.3) | 1.3 (1.3) |
| Metal (a)-containing compound | ammonium fluorotitanate | | | | | 2.1 (2.1) | | | | |
| | cobalt nitrate hexahydrate | | | | | | 2.5 (2.5) | | | |
| | ammonium metavanadate pentahydrate | | | | | | | 1.2 (1.2) | | |
| | ammonium tungstate pentahydrate | | | | | | | | 0.7 (0.7) | |
| | praseodymium nitrate hexahydrate | | | | | | | | | 1.5 (1.5) |

Parenthesized numerals show solid content.

TABLE 4

| | | Production Example 21 | Production Example 22 | Production Example 23 | Production Example 24 | Production Example 25 | Production Example 26 |
|---|---|---|---|---|---|---|---|
| | Film-forming agent | No. 10 | No. 11 | No. 12 | No. 13 | No. 14 | No. 15 |
| Bath | Emulsion No. 1 | | | | | | |
| | Emulsion No. 2 | | | | | | |
| | Emulsion No. 3 | | | | | | |
| | Emulsion No. 4 | 219.0 (70) | 219.0 (70) | 219.0 (70) | 219.0 (70) | 219.0 (70) | 219.0 (70) |
| | Pigment-dispersed paste No. 1 | 54.5 (30) | 54.5 (30) | 54.5 (30) | 54.5 (30) | | 54.5 (30) |
| | Pigment-dispersed paste No. 2 | | | | | 60.5 (33.3) | |
| | Deionized water | 726.5 | 726.5 | 726.5 | 726.5 | 753.5 | 726.5 |
| | 10% bath | 1000.0 (100) | 1000.0 (100) | 1000.0 (100) | 1000.0 (100) | 1033.0 (103.3) | 1000.0 (100) |
| Zr | ammonium fluorozirconate | 1.3 (1.3) | 1.3 (1.3) | 1.3 (1.3) | 1.3 (1.3) | | |
| Metal (a)- | magnesium nitrate hexahydrate | 5.3 (5.3) | | | | | |
| containing | lanthanum nitrate hexahydrate | | 1.6 (1.6) | | | | |
| compound | aluminum nitrate nonahydrate | | | 6.9 (6.9) | | | |
| | zinc nitrate nonahydrate | | | | 2.3 (2.3) | | |

Parenthesized numerals show solid content.

Example 1

A bath of film-forming agent No. 1 was adjusted to 28° C., and into which cold-rolled sheet steel (70 mm×150 mm×0.8 mm) which was the object to be coated and served as the cathode was immersed (interpolar distance: 15 cm). The first stage coating was carried out by applying electricity at 5 V for 60 seconds.

Continuously then the second stage coating was carried out by applying electricity at 260 V for 120 seconds, letting the cold rolled sheet steel (70 mm×150 mm×0.8 mm) as the anode (interpolar distance: 15 cm). Thus formed film was baked at 170° C. for 20 minutes with an electric dryer to provide a test panel No. 1.

The current density in the first stage electrification was 0.2 mA/cm$^2$.

Examples 2-14

Test panel Nos. 2-14 were prepared in the manner similar to Example 1, except that the film-forming agent and electrification conditions as shown in Tables 5 and 6 were used.

TABLE 5

| | | | Example 1 | Example 2 | Example 3 | Example 4 | Example 5 | Example 6 | Example 7 | Example 8 | Example 9 |
|---|---|---|---|---|---|---|---|---|---|---|---|
| | Test panel | | No. 1 | No. 2 | No. 3 | No. 4 | No. 5 | No. 6 | No. 7 | No. 8 | No. 9 |
| | Film-forming agent | | No. 1 | No. 2 | No. 3 | No. 4 | No. 5 | No. 6 | No. 7 | No. 8 | No. 9 |
| The first stage | Voltage (V) | | 5 | 5 | 5 | 5 | 10 | 15 | 15 | 30 | 30 |
| The coating object | sec. | | 60 | 60 | 60 | 60 | 50 | 30 | 30 | 30 | 30 |
| was cathode | Current density (mA/cm$^2$) (note 8) | | 0.2 | 0.2 | 0.2 | 0.2 | 0.4 | 0.6 | 0.6 | 1.0 | 1.0 |
| The second stage | Voltage (V) | | 260 | 270 | 270 | 270 | 200 | 200 | 160 | 160 | 200 |
| The coating object | sec. | | 120 | 120 | 120 | 120 | 100 | 100 | 90 | 90 | 90 |
| was anode | | | | | | | | | | | |
| Film | Film condition (note 9) | | ○ | ○ | ○ | ○ | ○ | ○ | ○ | ○ | ○ |
| structure | film (X) | Total amount of Zr and metal (a) (%) (note 10) | 99 | 98 | 99 | 98 | 98 | 99 | 98 | 99 | 90 |
| | | Film thickness (μm) | 0.1 | 0.2 | 0.1 | 0.1 | 0.2 | 0.2 | 0.2 | 0.2 | 0.2 |
| | film (Y) | Total amount of Zr and metal (a) (%) (note 10) | 10.5 | 8.8 | 5.5 | 10.4 | 4.6 | 5.7 | 10.2 | 16.3 | 7.2 |
| | | Resin component (B) content (%) (note 11) | 80 | 70 | 75 | 80 | 90 | 85 | 80 | 80 | 90 |
| | | Film thickness (μm) | 18.8 | 18.9 | 18.8 | 18.0 | 17.6 | 17.5 | 17.0 | 18.0 | 17.5 |
| Corrosion resistance (note 12) | | | ○ | ○ | ○ | ○ | ◎ | ◎ | ◎ | ◎ | ○ |
| Exposure resistance (note 13) | | | ○ | ○ | ○ | ○ | ◎ | ◎ | ◎ | ◎ | ◎ |
| Finished appearance (note 14) | | | ○ | ○ | ○ | ○ | ○ | ○ | ○ | ○ | ○ |
| Weatherability (note 15) | | | ○ | ◎ | ○ | ○ | ○ | ○ | ○ | ○ | ○ |
| Stability of film-forming agent (note 16) | | | ◎ | ◎ | ◎ | ◎ | ◎ | ◎ | ◎ | ◎ | ○ |

TABLE 6

| | | | Example 10 | Example 11 | Example 12 | Example 13 | Example 14 |
|---|---|---|---|---|---|---|---|
| Test panel | | | No. 10 | No. 11 | No. 12 | No. 13 | No. 14 |
| Film-forming agent | | | No. 10 | No. 11 | No. 12 | No. 13 | No. 14 |
| The first stage The coating object was cathode | Voltage (V) | | 7 | 7 | 7 | 7 | 7 |
| | sec. | | 80 | 90 | 90 | 90 | 90 |
| | Current density (mA/cm$^2$) (note 8) | | 0.3 | 0.2 | 0.2 | 0.2 | 0.2 |
| The second stage The coating object was anode. | Voltage (V) | | 170 | 250 | 200 | 210 | 170 |
| | sec. | | 100 | 90 | 90 | 90 | 90 |
| Film structure | Film condition (note 9) | | ○ | ○ | ○ | ○ | ○ |
| | film (X) | Total amount of Zr and metal (a) (%) (note 10) | 98 | 98 | 98 | 98 | 97 |
| | | film thickness (μm) | 0.2 | 0.2 | 0.2 | 0.2 | 0.2 |
| | film (Y) | Total amount of Zr and metal (a) (%) (note 10) | 14.3 | 11.3 | 20.2 | 12.3 | 14.1 |
| | | Resin component (B) content (%) (note 11) | 75 | 80 | 75 | 85 | 80 |
| | | film thickness (μm) | 17.7 | 17.6 | 17.5 | 15.5 | 18.2 |
| Corrosion resistance (note 12) | | | ○ | ○ | ○ | ○ | ○ |
| Exposure resistance (note 13) | | | ◎ | ◎ | ◎ | ◎ | ◎ |
| Finished appearance (note 14) | | | ○ | ○ | ○ | ○ | ○ |
| Weatherability (note 15) | | | ○ | ○ | ○ | ○ | ○ |
| Stability of film-forming agent (note 16) | | | ◎ | ◎ | ◎ | ◎ | ◎ |

Comparative Examples 1-14

Test panel Nos. 15-28 were prepared in the manner similar to Example 1, except that the film-forming agent and electrification conditions as shown in Tables 7 and 8 were used.

TABLE 7

| | | | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|---|---|
| Test panel | | | No. 15 | No. 16 | No. 17 | No. 18 | No. 19 | No. 20 | No. 21 | No. 22 | No. 23 | No. 24 |
| Film-forming agent | | | No. 1 | No. 2 | No. 3 | No. 4 | No. 5 | No. 6 | No. 7 | No. 8 | No. 9 | No. 10 |
| The first stage The coating object was cathode | Voltage (V) | | | | | | 70 | 110 | 110 | 110 | 0.9 | 110 |
| | sec. | | | | | | 130 | 70 | 150 | 90 | 180 | 180 |
| | Current density (mA/cm$^2$) | | | | | | 0.8 | 1.3 | 1.3 | 1.3 | 0.05 | 2.4 |
| The second stage The coating object was anode | Voltage (V) | | 260 | 260 | 260 | 260 | 220 | 170 | 250 | 180 | 160 | 160 |
| | sec. | | 180 | 180 | 180 | 180 | 50 | 110 | 30 | 150 | 90 | 90 |
| Film structure | Film condition (note 9) | | X | X | X | X | Δ | Δ | Δ | Δ | X | X |
| | film (X) | Total amount of Zr and metal (a) (%) (note 10) | — | — | — | — | 99 | 99 | 99 | 99 | — | — |
| | | film thickness (μm) | — | — | — | — | 0.4 | 0.4 | 0.5 | 0.6 | — | — |
| | film (Y) | Total amount of Zr and metal (a) (%) (note 10) | — | — | — | — | 35.2 | 28.3 | 26.4 | 28.9 | — | — |
| | | Resin component (B) content (%) (note 11) | — | — | — | — | 45 | 60 | 65 | 55 | — | — |
| | | film thickness (μm) | — | — | — | — | 13.2 | 14.0 | 16.5 | 15.5 | — | — |

TABLE 7-continued

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 | Comparative Example 10 |
|---|---|---|---|---|---|---|---|---|---|---|
| Corrosion resistance (note 12) | X | X | X | X | Δ | Δ | Δ | X | Δ | Δ |
| Exposure resistance (note 13) | X | X | X | X | Δ | Δ | Δ | Δ | Δ | Δ |
| Finished appearance (note 14) | ○ | ○ | ○ | ○ | ○ | ○ | ○ | ○ | ○ | Δ |
| Weatherability (note 15) | Δ | ○ | Δ | Δ | ○ | ○ | ○ | ○ | Δ | Δ |
| Stability of film-forming agent (note 16) | ○ | ○ | ○ | ○ | ○ | ○ | ○ | ○ | ○ | ○ |

TABLE 8

| | | | Comparative Example 11 | Comparative Example 12 | Comparative Example 13 | Comparative Example 14 |
|---|---|---|---|---|---|---|
| | Test panel | | No. 25 | No. 26 | No. 27 | No. 28 |
| | Film-forming agent | | No. 12 | No. 13 | No. 14 | No. 15 |
| The first stage | Voltage (V) | | 130 | 140 | 150 | 10 |
| | sec. | | 90 | 80 | 60 | 60 |
| The coating object was cathode | Current density ($mA/cm^2$) (note 8) | | 0.8 | 1.2 | 0.7 | 0.1 |
| The second stage | Voltage (V) | | 180 | 200 | 210 | 280 |
| | sec. | | 150 | 130 | 120 | 120 |
| The coating object was anode | | | | | | |
| Film structure | Film condition (note 9) | | Δ | Δ | Δ | X |
| | film (X) | Total amount of Zr and metal (a) (%) (note 10) | 99 | 99 | 99 | — |
| | | film thickness (μm) | 0.4 | 0.4 | 0.3 | — |
| | film (Y) | Total amount of Zr and metal (a) (%) (note 10) | 38.5 | 30.1 | 32.1 | — |
| | | Resin component (B) content (%) (note 11) | 55 | 60 | 60 | — |
| | | film thickness (μm) | 15.5 | 14.5 | 15.0 | — |
| Corrosion resistance (note 12) | | | X | X | X | X |
| Exposure resistance (note 13) | | | Δ | X | X | X |
| Finished appearance (note 14) | | | ○ | ○ | ○ | ○ |
| Weatherability (note 15) | | | ○ | ○ | ○ | Δ |
| Stability of film-forming agent (note 16) | | | ○ | ○ | ○ | ○ |

(note 8) Current density: The cold-rolled sheet steel (70 mm × 150 mm × 0.8 mm) which was the coating object was immersed in film-forming agent as the cathode (interpolar distance: 15 cm) and the current density at the time of applying the voltage in the first stage was measured.
(note 0) Film condition: Each test panel was cut and the coating conditions of the film (X) and film (Y) were observed with HF-2000 (tradename, Hitachi Seisakujo, a field emission transmission electron microscope). Evaluation of the coating condition was given according to the following standard: ○: layer distinction was clearly recognizable; Δ: the borderline between the film (X) and the other film (Y) was not clear but layer distinction was more or less recognizable. X: no layer distinction possible.
(note 10) Total amount of Zr and metal (a) (%): The amount of total metal (mass %) in film (X) was measured with IX-3100 RF (tradename, K. K. Rigaku, a fluorescent X-ray spectroanalyzer).
(note 11) Resin component (B) content: Film (Y) before hardening by baking was scraped off, from which the resin content was calculated according to the following equation (2): Mass of the film (Y) which was dried at 105° C. for 3 hours b1 Residual mass of the film after 5 hours' baking in a crucible at 800° C. b2 Content (%) of resin component (B) = [(b1 − b2)/b1] × 100 equation (2).
(note 12) Corrosion resistance: Coating film on each test panel was cross-cut with a knife to the depth reaching the substrate surface, and the test panel was given a saline solution spray resistance test for 480 hours following JIS Z-2371. Corrosion resistance was evaluated by the following standard according to width of rust and blister development from the knife cuts: ◎: the maximum width of rusting and blistering from the cuts was less than 2 mm (single side); ○: the maximum width of rusting and blistering from the cuts was no less than 2 mm but less than 3 mm (single side); Δ: the maximum width of rusting and blistering from the cuts was no less than 3 mm but less than 4 mm (single side); X: the maximum width of rusting and blistering from the cuts was 4 mm or more (single side).

TABLE 8-continued

| | Comparative Example 11 | Comparative Example 12 | Comparative Example 13 | Comparative Example 14 |
|---|---|---|---|---|

(note 13) Exposure resistance: The test panels were applied with WP-300 (tradename, Kansai Paint Co., a water-borne intermediate paint) by spray-coating method, to a hardened film thickness of 25 μm, and baked at 140° C. × 30 minutes in an electric hot air dryer. Further onto the intermediate coating film NEO AMILAC 6000 (tradename, Kansai Paint Co., a top paint) was applied by spray coating method, to a hardened film thickness of 35 μm, which was subsequently baked at 140° C. × 30 minutes in an electric hot air dryer, to provide panels for exposure test. The coating films on the exposure test panels were cross-cut with a knife to the depth reaching the substrate, and the panels were exposed to the open air in horizontal position for a year in Chikura-cho, Chiba Prefecture, Japan. The exposure resistance was evaluated according to the rusting and blistering width from the knife cuts, by the following standard: ◎: the maximum width of rusting and blistering from the cuts was less than 2 mm (single side), ○: the maximum width of rusting and blistering from the cuts was no less than 2 mm but less than 3 mm (single side), Δ: the maximum width of rusting and blistering from the cuts was no less than 3 mm but less than 4 mm (single side), and X: the maximum width of rusting and blistering from the cuts was no less than 4 mm (single side)

(note 14) Finished appearance: Surface roughness value ($R_a$) of the coated plane of each test panel was measured with SURF TEST 301 (tradename, MITSUTOYO Co., a surface roughness tester) at a cutoff of 0.8 mm and the evaluation was given according to the following standard: ○: the surface roughness value ($R_a$) was less than 0.2 μm, Δ: the surface roughness value ($R_a$) was no less than 0.2 μm but less than 0.3 μm, X: the surface roughness value ($R_a$) was no less than 0.3 μm.

(note 15) Weatherability: The test panels each coated with a coating film of 20 μm in dry thickness were subjected to the accelerated weatherability test as prescribed by JIS K-5600-7-7, and the time at which the 60° specular reflectivity (%) dropped below 80% was measured. ◎: the time by which the 60° specular reflectivity (%) dropped below 80% was not less than 200 hours; ○: the time by which the 60° specular reflectivity (%) dropped below 80% was not less than 150 hours but less than 200 hours; Δ: the time by which the 60° specular reflectivity (%) dropped below 80% was not less than 50 hours but less than 150 hours; X: the time by which the 60° specular reflectivity (%) dropped below 80% was less than 50 hours.

(note 16) Stability of film-forming agent: Each of the film-forming agents was stirred in a sealed container at 30° C. for 30 days. Thereafter each the total amount of the film-forming agent was filtered through a 400 mesh-filtration net. The amount of the residue (mg/L) was measured: ◎: less than 5 mg/L, ○: no less than 5 mg/L but less than 10 mg/L, Δ: no less than 10 mg/L but less than 15 mg/L, X: no less than 15 mg/L.

The invention claimed is:

1. A method for forming a surface-treating film, which comprises applying a film-forming agent onto a metal substrate by a multistage electricity-applying system comprising at least two stages, wherein (i) the film-forming agent comprises 30-20,000 ppm, in terms of the total amount of metals (as converted to mass), of zirconium compound optionally, a compound containing at least one metal (a) which is selected from the group consisting of titanium, cobalt, vanadium, tungsten, molybdenum, copper, zinc, indium, aluminum, bismuth, yttrium, lanthanide metals, alkali metals and alkaline earth metals, and 1-40% by mass of an anionic group-containing resin component, (ii) the first stage coating is conducted, in the state that the metal substrate is immersed in the film-forming agent, by applying electricity at a voltage of 1-50 V for 10-360 seconds, using the metal substrate as the cathode, and (iii) the second and subsequent stage coating is conducted, in the state that the metal substrate is immersed in the film-forming agent, by applying electricity at a voltage of 50-400 V for 60-600 seconds, using the metal substrate as the anode.

2. A method according to claim 1, in which the first stage coating is conducted at a current density of 0.05-1.5 mA/cm$^2$.

3. A method according to claim 1, in which the film-forming agent contains 50-10,000 ppm, in terms of the total amount of metal (as converted to mass), of zirconium compound and metal (a) containing compound.

4. A method according to claim 1, in which the film-forming agent contains 5-35 mass % of the resin component.

5. A method according to claim 1, in which the first stage coating is conducted by applying electricity at a voltage of 2-40 V for 30-300 seconds, using the metal substrate as the cathode, and the second and subsequent stage coating are conducted, by applying electricity at a voltage of 75-370 V for 75-400 seconds.

6. A method according to claim 1, in which the anionic group-containing resin component comprises anionic resin and crosslinking agent.

7. A method according to claim 6, in which the anionic resin is selected from carboxyl-containing polyester resin, carboxyl-containing acrylic resin and carboxyl-containing epoxy resin.

8. A method according to claim 6, in which the crosslinking agent is selected from blocked polyisocyanate compound and melamine resin.

* * * * *